United States Patent [19]

Saito

[11] 4,109,410

[45] Aug. 29, 1978

[54] TOY MOTOR CAR CIRCUIT

[76] Inventor: Shigeru Saito, No. 6-4, 2-chome, Kuramae, Taito-ku, Tokyo, Japan

[21] Appl. No.: 721,413

[22] Filed: Sep. 8, 1976

[30] Foreign Application Priority Data

Sep. 19, 1975 [JP] Japan ..... 50-128806[U]

[51] Int. Cl.[2] ..... A63H 29/16

[52] U.S. Cl. ..... 46/44; 46/12; 46/43; 46/202

[58] Field of Search ..... 46/44, 43, 202, 12

[56] References Cited

U.S. PATENT DOCUMENTS

| | | | |
|---|---|---|---|
| 1,472,783 | 11/1923 | Bauer | 46/43 X |
| 2,890,537 | 6/1959 | Benko | 40/37 |
| 3,281,985 | 11/1966 | Einfalt | 46/202 |
| 3,469,340 | 9/1969 | Breneman et al. | 46/44 |
| 3,593,454 | 7/1971 | Einfalt | 46/12 |

*Primary Examiner*—F. Barry Shay
*Attorney, Agent, or Firm*—Michael J. Striker

[57] ABSTRACT

A toy has an upright hollow rectangular-section tower formed at one side at its upper end with an exit opening and on the other side at its lower end with an entrance opening. An inclined ramp has an upper end at the exit opening and a lower end at the entrance opening and there is provided at this entrance opening a pivotal flap which prevents air exiting from the tower but allows a small toy motor car which is displaceable along the ramp to move through the door into the tower. An elevator is vertically displaceable in the tower and has a bottom wall adapted to support the car and inclined from the entrance-opening side of the tower toward the exit-opening side of the tower. A battery-powered blower is provided in the base of the housing for the tower and has an output opening into the very bottom of the tower so that when this blower is energized by means of a remote-controlled switch it creates a gas column in the tower which lifts the elevator from a position aligned with the entrance opening to a position aligned with the exit-opening. Thus the car can be displaced by this elevator up to the top of the ramp which it will then descend by its own weight. An abutment is provided at the lower end of the ramp in front of the entrance opening of the tower for preventing the toy motor car from automatically rolling back into the tower after completing a circuit down the ramp.

10 Claims, 5 Drawing Figures

TOY MOTOR CAR CIRCUIT

BACKGROUND OF THE INVENTION

This invention relates to a toy motor car circuit that a motor car may be lifted by an elevator and descending by its own weight from the toy to the bottom of an elevating means along an attached inclined lane or ramp.

Heretofore, customary movable motor car toys almost always employ a spring prime mover or an electric motor. Accordingly, they can perform nothing but run uncontrollably on a plain floor.

SUMMARY OF THE INVENTION

One object of this invention is to provide a toy motor car circuit wherein an elevating means and an inclined lane constitute a motor car circuit and a motor car may be lifted by an elevator and run down along the inclined lane.

Another object of this invention is to provide a toy motor car circuit with which children can enjoy a circuit motion of the motor car with amusing interest.

Briefly stated in accordance with this invention, there is provided a toy motor car circuit which comprises a motor car, an elevating means and an inclined lane. These assemblies are most made from plastics. The elevating means consists of a base frame and a rectangular tower frame and houses an elevator inside said tower frame. The tower frame is mounted onto the base frame and may be equipped with the inclined lane of which both ends may be fixed to an upper exit and a lower entrance of the tower frame, respectively. The base frame is provided with a fan, an electric motor and dry cells. The fan is confined in a fan compartment of said base frame and is fixed to the spindle of the electric motor which protrudes from the other compartment. The electric motor and the dry cells may operate by a switch. The fan compartment has an air intake opening through which air is drawn in from the outside and has an air output opening through which air is expelled into the bottom space of the tower frame. The elevator is box-shaped and is opened at both front and rear sides, and has a bottom plate inclined from the front to the rear. It is adapted to contact airtightly the four side walls of the tower frame so as to reciprocate inside the tower frame. The expelled air acts as a gas-column at the bottom of the elevator and may lift it up. Therefore, a motor car loaded in the elevator is lifted from the bottom to the top inside the tower frame and descends by its own weight from the top to the bottom along the outside inclined lane.

As mentioned above, this toy is an amusing and attractive one wherein a motor car may perform easily a circuit motion by operation of a switch.

BRIEF DESCRIPTION OF THE DRAWING

This invention will be better understood and other objects and additional advantages of this invention will become apparent upon perusal of the following description taken in connection with accompanying drawings, in which.

SPECIFIC DESCRIPTION OF A PREFERRED EMBODIMENT

Figure 1:
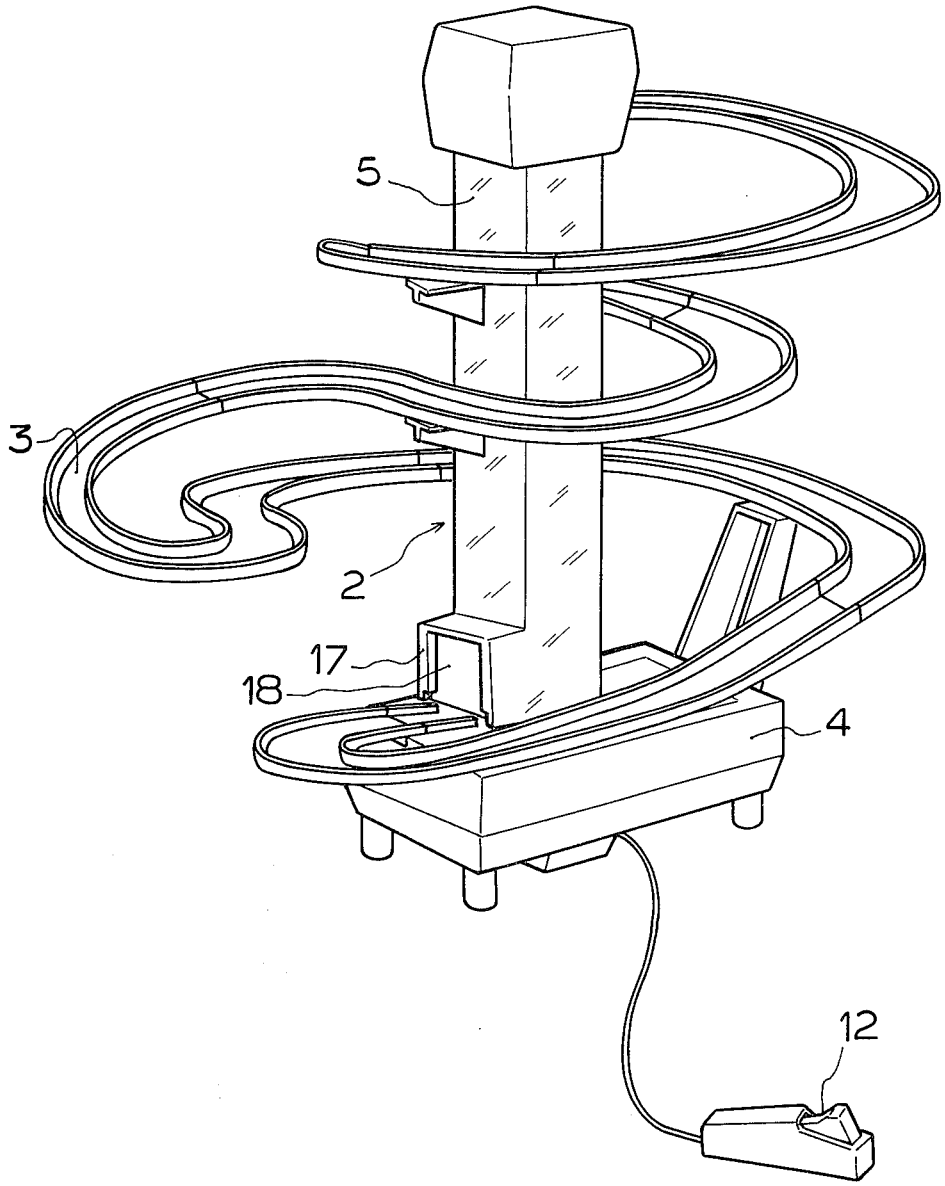
FIG. 1 is a perspective view of a toy motor car circuit of this invention comprising an elevating means and an inclined lane.
Figure 2:
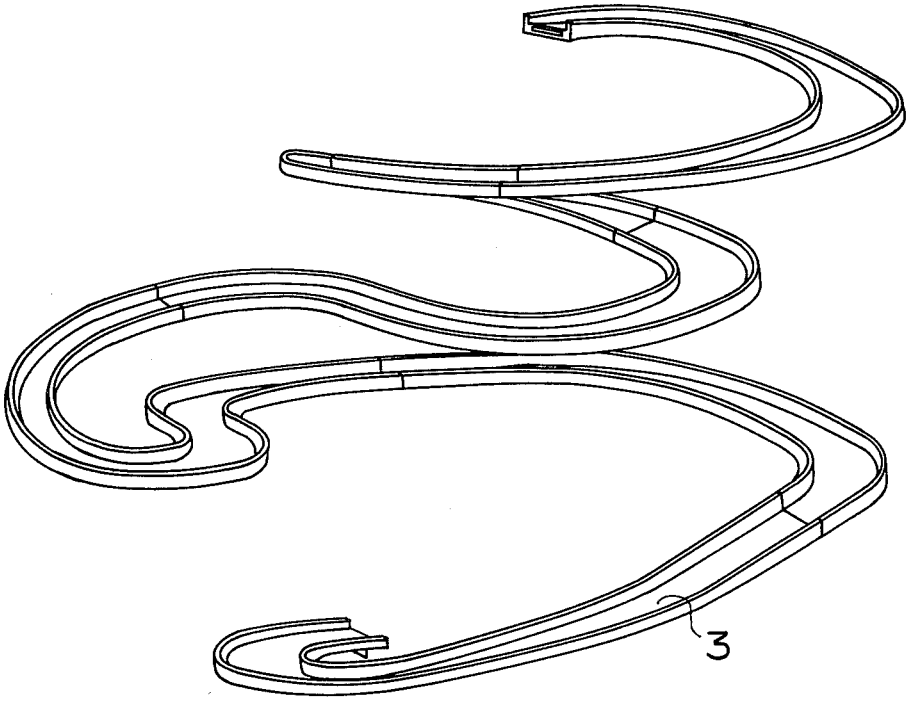
FIG. 2 is a perspective view of the inclined lane thereof.
Figure 3:
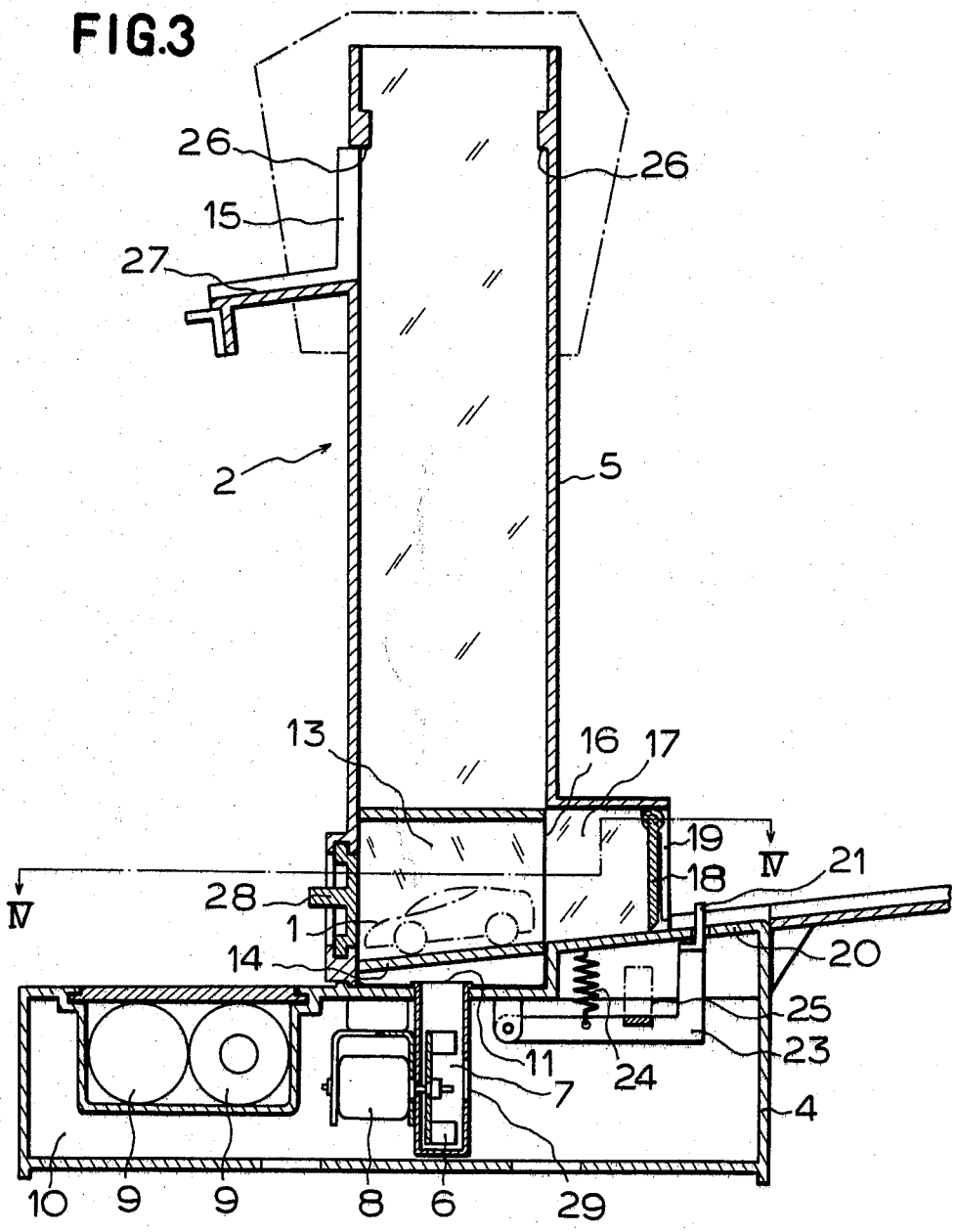
FIG. 3 is a side section of the elevating means cut vertically through the side portions of a tower frame and a base frame thereof.
Figure 4:
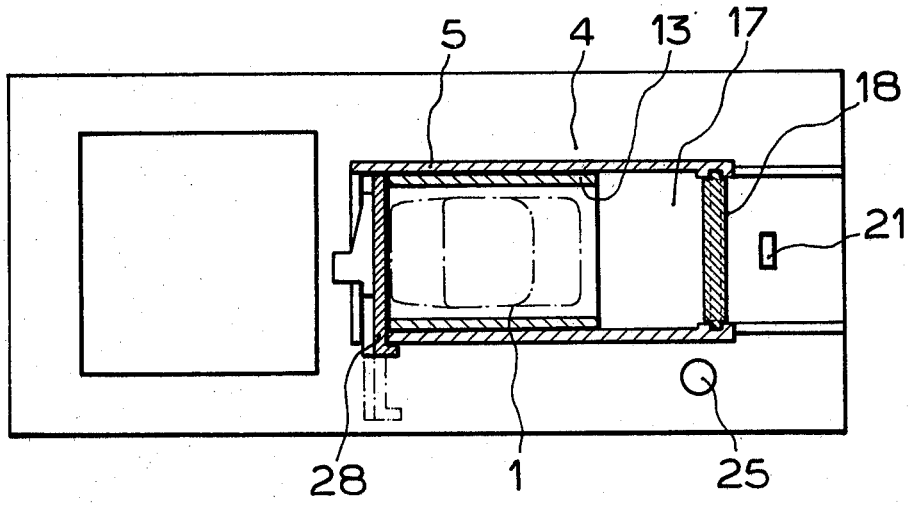
FIG. 4 is a sectional plan view of the elevating means taken along lines IV—IV in FIG. 3.
Figure 5:
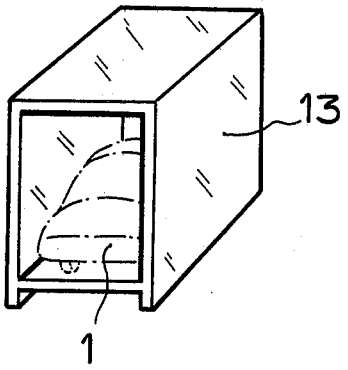
FIG. 5 is a perspective view of an elevator thereof.

Referring more particularly to the drawings, the preferred embodiment of this invention will now be described as follows;

The mechanism of this invention may also be illustrated referring particularly to FIG. 3. The toy motor car circuit comprises a motor car 1, an elevating means 2 and an inclined lane or ramp 3. The elevating means is so constructed from a base frame 4 and a rectangular tower frame 5. The tower frame 5 is fixed onto the base frame 4. The base frame 4 is partially partitioned with a fan compartment 7 and a fan 6 is confined in said fan compartment 7. An electric motor 8 and dry cells 9 are housed in the other compartment 10 of the base frame 4. The fan compartment 7 has an opening 29 for drawing in air from the outside and an opening 11 for expelling air into the tower frame 5. The fan 6 is fixed to the spindle of the electric motor 8. The electric motor 8 and the dry cells 9 are provided with a switch 12 (FIG. 1) between them. The tower frame 5 houses a box-shaped elevator 13 which is opened at both front end rear sides and has a bottom plate 14 inclined from the front to the rear. The elevator 13 is adapted to contact the four side walls of the tower frame 5 in an airtight manner so as to reciprocate inside the tower frame 5 in piston-fashion. The tower frame 5 has a bottom on the base frame 4, an exit 15 at the upper portion of the back side wall and an entrance 16 at the lower portion of the front side wall. Outside the entrance 16, there is a front chamber 17 shut by a check valve-type pivoted door 18 from the outside. The door 18 is pivoted at the upper edge of the front chamber inlet 19 by the upper side of the door 18 and closely engages an inclined entrance guide plate 20 by the lower side of the door 18. An inlet stopper 21 projects upward through a perforation 22 on the guide plate 20 outside the pivoted door 18. This stopper 21 is a front end portion of an B-shaped lever 23 which is pivoted at the outside of the bottom of the tower frame 5 by its other end. The lever 23 is suspended at a definite position by a tension spring 24 to push the stopper 21 upward through the perforation. A stopper button 25 is attached onto the base frame 4 so as to sink the stopper 21 beneath the entrance guide plate 20 by pushing of this button. The mechanism of this invention is constituted as mentioned above. Therefore, if the motor car 1 is placed on the inclined lane 3, it descends along the lane 3 and stops at the stopper 21. In case the elevator 13 which is positioned at the bottom of the tower frame 5 is vacant, if the stopper 21 is sunk below the entrance guide plate 20 by pushing the button 25, the motor car 1 pushes through the pivoted door 18 into the elevator 13. Then, the electric motor 8 is operated by pushing the switch 12 and the fan 6 works inside the fan compartment 7 draw in air from the outside and expel the air through the exhaling opening 11 into the bottom of the tower frame 5 which is closed except of the opening 11. Therefore, air exhaled inside the tower frame 5 does not escape into the outside and acts as a pressure column to lift up the elevator 13 inside the tower frame 5. The elevator 13 is made to stop at the top of the tower frame 5 by a top stopper or abutment 26. Accordingly, the elevator 13 can lift the motor car 1 from the bottom to the top inside the tower frame 5. If the elevator 13 is positioned at the top, the opened back of the elevator 13 coincides with the exit 15 of the tower frame 5 in height at the position. The motor car 1 slides from the inclined bottom plate of the elevator 13 to the exit guide plate 27 by its own weight and descends along the inclined lane 3 to the inlet stopper or abutment 21. Then if the switch 12 is open, the motor 8 and the fan 6 are stopped and air is not sent into the bottom of the tower frame 5. Therefore, a gas column is not present in the tower frame 5, so the elevator 13 falls by its own weight from the the top to the bottom inside the tower frame 5.

Thus, by pushing the button 25, the stopper 21 is sunk below the entrance guide plate 20 and the motor car 1 enters the elevator 13 positioned on the bottom of the tower frame 5 and, by switching on the motor 8, the motor car 1 is lifted with the lift 13 from the bottom to the top inside the tower frame 5 and next descends along the inclined lane 3. Thus the circuit motion of the motor car 1 which comprises an ascending motion and a descending motion is easily repeated by operations of the button 25 and the switch 12.

The tower frame 5 may be provided with a sliding door 28 at the lowest portion of the back side wall to pull out the motor car 1 from the bottom of said tower frame 5 in case the motor car 1 is not loaded on the elevator 13 and falls on the bottom of the tower frame 5 by mistake.

The toy motor car circuit described above has a single-line ramp. Employing two sets of the toy motor car circuits of this invention, a race of the two motor cars can be enjoyed. For this purpose, the two sets of the toys may be assembled into one toy set. Namely, the two elevating means are arranged side by side and united into one assembly and an inclined two-lane is used. Therefore, the united elevating means and the double-laned ramps may constitute a double motor car circuit so that two motor cars may race while running on respective lanes.

As mentioned above, this invention provides a new and amusing toy which may attract children's interest.

While a particular embodiment of this invention has been illustrated and described, it is obvious that many modifications and variations of this invention are possible in the light of the above teachings. It is, therefore, to be understood that within the scope of the appended claims the invention may be practised otherwise as specifically described.

What we claim is:

1. A toy comprising: an upright hollow tower having an upper end formed with an exit opening and a lower end formed with an entrance opening; an elevator vertically displaceable in said tower piston-fashion and having a bottom wall; a ramp having an upper end at said exit opening and a lower end at said entrance opening; a toy motor car displaceable down along said ramp under its own weight and fittable on said bottom wall of said elevator; door means for preventing emission of air from said tower through said entrance opening but for permitting said car to enter said tower through said entrance opening; and means for supplying air under pressure to the interior of said tower beneath said entrance opening and for forming a gas column in said tower capable of vertically displacing said elevator with said car on said bottom wall from a position aligned with said entrance opening to a position aligned with said exit opening.

2. The toy defined in claim 1 wherein said tower has two opposite sides, one of which is formed with said exit opening and the other of which is formed with said entrance opening, said bottom wall being inclined downwardly from said other side toward said one side.

3. The toy defined in claim 1 wherein said means for supplying includes a blower having an output connected to said interior of said tower.

4. The toy defined in claim 3, further comprising a base below and carrying said tower, said means for supplying including dry cells in said base, an electric motor connected to said fan, and means for connecting said dry cells to said electric motor.

5. The toy defined in claim 4 wherein said means for connecting includes a wire connected to said cells and to said motor and a switch remote from said base and connected to said wire.

6. The toy defined in claim 1, further comprising an abutment on said ramp immediately adjacent said entrance opening and displaceable from a position preventing said toy car from moving along said ramp past said abutment to a position out of the way of said toy car, and means for displacing said abutment between said positions.

7. The toy defined in claim 6, further comprising a spring urging said abutment into the first-mentioned position.

8. The toy defined in claim 1 wherein said means for preventing includes a door swingable about a horizontal axis between a position blocking said entrance opening and a position extending into said tower.

9. The toy defined in claim 1 wherein said tower is provided with an openable door on its said lower end opposite said entrance opening.

10. The toy defined in claim 1 wherein said tower is of rectangular section and said bottom wall is of complementary rectangular shape.

* * * * *